US005515925A

United States Patent [19]

Boychuk

[11] Patent Number: 5,515,925

[45] Date of Patent: May 14, 1996

[54] APPARATUS AND METHOD FOR INSTALLING COILED TUBING IN A WELL

[76] Inventor: Randy J. Boychuk, 7815 Leaf Point Ct., Houston, Tex. 77095

[21] Appl. No.: 308,407

[22] Filed: Sep. 19, 1994

[51] Int. Cl.[6] ..... E21B 19/10; E21B 33/04

[52] U.S. Cl. ..... 166/379; 166/88.3; 166/382; 285/145; 285/147

[58] Field of Search ..... 166/88, 86, 77, 166/379, 382; 285/147, 146, 145

[56] References Cited

U.S. PATENT DOCUMENTS

| | | | |
|---|---|---|---|
| 1,579,648 | 4/1926 | Crickmer | 285/147 |
| 2,137,853 | 11/1938 | Nixon | 285/146 X |
| 2,194,265 | 3/1940 | Abercrombie | 285/147 X |
| 3,090,640 | 5/1963 | Otteman et al. | 285/145 X |
| 4,646,827 | 3/1987 | Cobb | 166/88 |
| 4,844,166 | 7/1989 | Going, III et al. | 166/379 |
| 5,027,903 | 7/1991 | Gipson | 166/382 |
| 5,092,400 | 3/1992 | Jagert | 166/88 |
| 5,411,085 | 5/1995 | Moore et al. | 166/242 |

*Primary Examiner*—Hoang C. Dang
*Attorney, Agent, or Firm*—Bill B. Berryhill

[57] ABSTRACT

Hanger apparatus for suspending coiled tubing in a well including a tubing head having a vertical flow passage therethrough. An annular sealing assembly is carried in a low counterbored portion of the flow passage. A slip assembly is carried in an upper counterbored portion of the flow passage. The slip assembly is moveable between an outwardly expanded passive position in which the slip assembly does not interfere with the flow passage and an inwardly contracted active position in which gripping surfaces carried on the slip assembly engages the coiled tubing to support the weight thereof, the weight of the tubing being transferred from the slip assembly to the sealing assembly. Slip activators carried by the tubing head are manipulatable externally of the tubing head to move the slip assembly from passive positions to active positions. A method of utilizing the apparatus to install coiled tubing in a well is disclosed.

23 Claims, 3 Drawing Sheets

APPARATUS AND METHOD FOR INSTALLING COILED TUBING IN A WELL

BACKGROUND OF THE INVENTION

1. Field of the Invention

The present invention pertains to methods and apparatus for installing and suspending tubing in an oil and/or gas well. More specifically, the present invention pertains to methods and apparatus for installing and suspending coiled tubing in an oil and/or gas well.

2. Description of the Prior Art

In the drilling and completion of an oil and/or gas well, a hole is drilled through the earth to a subterranean formation which comprises a reservoir for oil and/or gas. Typically, the drilled hole is lined with a string of pipe, sometimes referred to as a "casing string", and one or more smaller diameter strings of pipe are lowered therein and supported at the surface of the well by a wellhead. The smaller diameter pipe, sometimes referred to as "tubing", is the pipe through which the oil and/or gas typically rises to the surface of the well, by natural pressures or by pumping, for production.

Typically, such production tubing is manufactured in rigid joints of 40 to 80 foot sections. The joints must be transported to the well, stored on a pipe rack and vertically positioned in a derrick or the like before installation in the well. Then they are threadedly connected, joint by joint, as the string is lowered into the well. If it becomes necessary to reposition or remove the tubing, it must be disconnected, joint by joint, and removed from the well. Obviously, these procedures are labor and time intensive, resulting in relatively expensive operations.

In recent years, coiled tubing has been developed and used in the oil field as an alternative to conventional jointed tubing. Coiled tubing offers many advantages over conventional jointed tubing, including time and labor savings, pumping flexibility, elimination of leakage and leak testings, reduced formation damage, safety, etc. The coiled tubing may range in sizes from ¾" OD up to 3½" OD. The operational concept of a coiled tubing system involves running a continuous string of small diameter tubing into a well to perform specific well servicing operations without disturbing existing completion tubulars and equipment. When servicing is complete, the small diameter tubing may be retrieved from the well and spooled onto a large reel for transport to and from work locations.

Although coiled tubing has been in use since the early 1960's, it's use in production applications has only begun to gain widespread acceptance in the last few years. Producers have for several years successfully used concentric coiled tubing inside larger conventional tubing to enable the wells to continuously unload liquids. For example, coiled tubing has been used to jet sludge from wells as deep as 20,000 feet prior to hanging the string off and then unloading water through the "siphon" tubing to increase gas production. In the past few years, coiled tubing has begun to gain acceptance as a primary production string. Coiled tubing can be run in underbalanced well conditions to minimize formation damage from completion of work over operations. Installation and removal are generally faster than with jointed pipe. Joint connections are reduced or eliminated, minimizing potential for leaks and the need for testing connections. Cost are competitive with jointed pipe in most sizes. Coiled tubing is compatible with most artificial lift methods.

The typical procedure for hanging coiled tubing from the surface as a production or an injection string may include the following steps:

1. Rigging up a coiled tubing unit and killing the well if necessary.
2. Installing a coiled tubing head. This may already be in place or may be in addition to existing wellhead equipment. Many times the tubing head will be installed on the lower master valve.
3. Nippling up or installing blowout preventers (BOP's) on the tubing head. This usually also includes, above the blowout preventers, an access window assembly.
4. Running coiled tubing with shear out or pump out bottom plug on the lower end to prevent possible well flow back through the coil tubing. The BOP's may be used for annular well control.
5. When the end of the coiled tubing reaches the desired depth, the lower set of BOP's are closed and the tubing is checked for leaks.
6. The distance from the bottom flange of the access window assembly to tubing head lock screws is measured to insure that the annular hanger assembly sets completely in its hanger profile.
7. Wrap around style hanger assembly (with slips and seals) is placed around the coiled tubing and slowly lowered to the top of the lower set of blowout preventer rams.
8. The upper blowout preventers are closed and the lower blowout preventers are opened, allowing pressure to equalize across the spool.
9. The hanger assembly is lowered to the depth of the hanger bowl and the weight of the tubing is landed on the hanger. Lock down screws are engaged and the hanger's seals are pressure tested.
10. The coiled tubing is rough cut through the window of the access window assembly and the blowout preventers and access window assembly are removed.
11. A final or smooth cut is made on the coiled tubing and it is beveled to fit an adapter and to avoid damaging adapter seals. The remaining wellhead equipment is then installed and flow lines connected.
12. The coiled tubing is pressured up to shear out the bottom plug.
13. The well is placed in service.

In the typical coiled tubing installation of the prior art just described, it is, as indicated, necessary to provide an access window assembly above the blowout preventers to provide access to the coiled tubing and the annular space surrounding the coiled tubing in the tubing head. It is necessary to open the access window assembly for placement of the hanger assembly around the coiled tubing so that it may be lowered into the tubing head. Even though pressure control may be maintained by blowout preventers, this potentially opens the annular space surrounding the coiled tubing to pressure in the well. As is well known in the industry, an oil and/or gas well that is not under total pressure control can result in dangerous situations. Furthermore, the fact that the hanger assembly must be lowered around the coiled tubing from a point near the bottom of the access window assembly to the seating area in the tubing head, without being seen, provides a potential for improper seating of the hanger seal and actuation of it's slips. Furthermore, the wrap-around slip and sealing assemblies of the hangers are inherently more likely to create sealing or slip engagement problems than seal or slip assemblies which are continuous.

Thus, even though coiled tubing installations, particularly production applications thereof, have become widely accepted in the last few years, apparatus and methods for completing and producing wells with coiled tubing continue to be developed. Many improvements have been made. Many other improvements would be desired.

SUMMARY OF THE PRESENT INVENTION

The present invention provides methods and apparatus for installing coiled tubing in an oil and/or gas well, particularly for production of hydrocarbon fluids therefrom. The principal apparatus of the present invention is a tubing head and hanger which, unlike the prior art, is designed so that the tubing unit stripper or blowout preventers do not have to be disconnected to hang the coiled tubing string in the well. Furthermore, all components of the hanger apparatus are internal, eliminating the need to install access window assemblies to set the tubing in the hanger and thus eliminating the pressure control problems associated with such.

The hanger apparatus of the present invention includes a tubing head, having a vertical flow passage therethrough, for surmounting on the wellhead of the well. An annular sealing assembly is carried in a counterbored portion of the flow passage and a slip assembly is carried in a second counterbored portion above the first mentioned counterbored portion. The sealing and slip assemblies make up the hanger assembly.

The annular sealing assembly includes a continuous annular seal member through the central opening of which the coiled tubing may be lowered or raised but which, when a vertical force is applied thereto, will expand outwardly to seal against surrounding surfaces of the tubing head and expand inwardly to seal against the exterior of the coiled tubing. The slip assembly is moveable between an outwardly expanded passive position in which the slip assembly does not interfere with the flow passage and the lowering or raising of the coiled tubing therein and an inwardly contracted active position in which gripping means carried on the slip assembly engages the coiled tubing to support the weight thereof. When so engaged, the weight of the tubing is transferred from the slip assembly to the sealing assembly to provide the vertical sealing force thereto.

Also carried by the tubing head are slip activation devices which engage the slip assembly within the second counterbored portion of the flow passage and which are manipulatable externally of the tubing head to move the slip assembly from its passive position to its active position. In a preferred embodiment of the invention, the slip activation devices are a plurality of screws which may be rotated externally of the tubing head but which extend through threaded holes for engagement with the slip assembly for movement thereof.

In the method of installing coiled tubing with the apparatus of the present invention, the coiled tubing hanger apparatus, which includes the tubing head, an annular seal assembly and a slip assembly are all installed on the wellhead, completely assembled, prior to lowering the coiled tubing into the well. A blowout preventer stack and the coiled tubing injector apparatus are installed thereabove. The coiled tubing is run through the blowout preventer stack and the coiled tubing head until the string of coiled tubing reaches its desired depth in the well. This is done while the slip assembly is in its expanded passive position. After the coiled tubing has reached the proper depth, the slip assembly is activated externally of the tubing head, the slips thereof moving to a contracted active position grippingly engaging a portion of the coiled tubing which it surrounds. Then the coiled tubing is slightly lowered to allow the weight of the tubing string to be totally supported by the slip assembly, the weight of the coiled tubing also expanding the sealing assembly to seal around the coiled tubing. After the coiled tubing is so hung and sealed, it is cut off at a point above the hanger apparatus, the injection apparatus and the blowout preventer stack are removed and remaining wellhead equipment installed.

Thus, the apparatus and method of the present invention allows the use of coiled tubing for production applications without having to disconnect the tubing injector apparatus or blowout preventers and without having to use an access window assembly. There is complete pressure control of the well at all times. The internal slip and seal assemblies are contained within the coiled tubing head but are activated externally thereof. Furthermore, the slip assembly may be moved or retracted to an active position to allow the coiled tubing to be repositioned, lower or higher in the well, without pulling the tubing. Many other objects and advantages of the apparatus and method of the present invention will be apparent from reading the description which follows in conjunction with the accompanying drawings.

DESCRIPTION OF PREFERRED EMBODIMENT OF THE INVENTION

Figure 1:
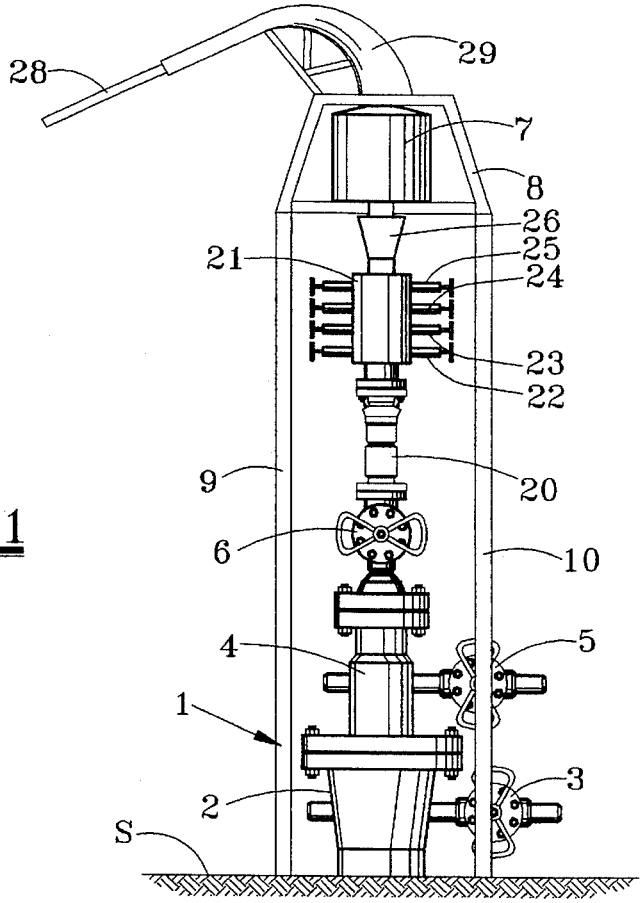
FIG. 1 is a vertical elevation view of the wellhead of an oil and/or gas well and the hanger apparatus for running and hanging a string of coiled tubing therein according to a preferred embodiment of the invention.
Figure 4:
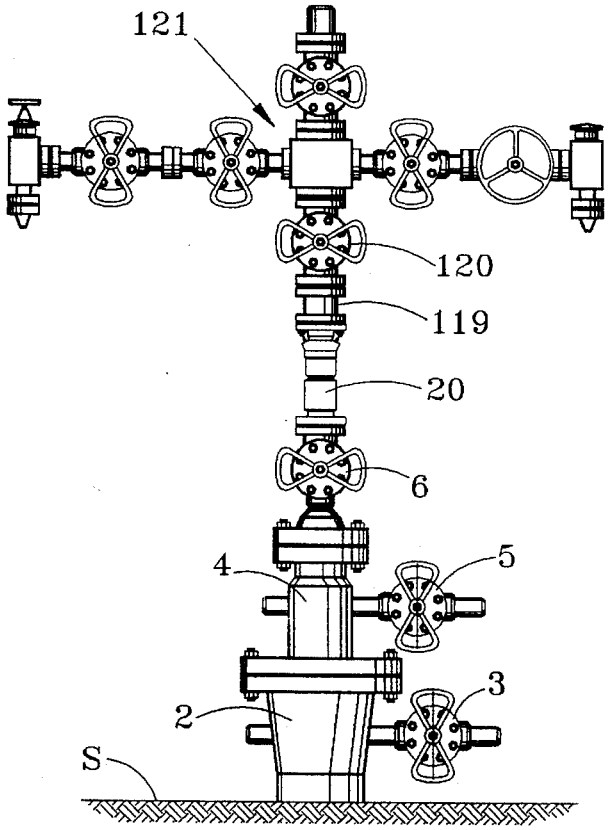
FIG. 4 is a vertical elevation view of a completed wellhead utilizing the coiled tubing hanging apparatus of the present invention, according to a preferred embodiment thereof 2.

Referring first to FIG. 1, there is shown the wellhead 1 of an oil and/or gas well which is to produce from a subterranean formation many feet below the surface S. The wellhead 1 is made up of a number of components. For example, a casing head 2 may be attached to the upper end of an outer casing and equipped with one or more valves 3. Another casing or tubing head 4 equipped with one or more valves 5 may be surmounted on the casing head 2 and may be attached to the upper end of a smaller production or casing or tubing string. One or more tubing strings may be supported in the tubing head 4 from a tubing hanger (not shown) at the upper end thereof. In fact, such a tubing string may actually be the original production tubing through which the well produces. A master control valve 6 may be attached to the upper end of the tubing head 4. The casing and tubing strings (not shown) supported from the casing head 2 and tubing head 4 and/or the tubing strings supported therein might be strings previously placed in the well at some prior time. In any event, for purposes of illustrating the present invention, it is to be assumed that a string of coiled tubing is to be run into the well, the coiled tubing would be concentrically disposed within the innermost string of jointed pipe, either a casing string or a tubing string.

To begin running a coiled tubing, a coiled tubing unit which includes a tubing injector 7 would need to be brought in place. The injector 7 is typically provided with a protective frame 8 and mounted on adjustable support legs 9 and 10. Prior to the connection of the injector head 7 for running of the coiled tubing, it may be necessary to kill the well. A coiled tubing head 20 is installed. The coiled tubing head 20 illustrated in FIG. 1 is a specially designed coiled tubing head which includes hanger apparatus, including an internal sealing assembly and slip assembly for supporting coiled tubing in the well. This coiled tubing head 20 will be described in greater detail hereafter. For present purposes, it should be mentioned that the coiled tubing head 20 could already be in place or may be an addition to existing wellhead equipment. Most times, the coiled tubing head 20 would be installed directly above the lower master valve 6. If other wellhead equipment previously exists above the lower master valve 6, it may have to be removed.

Mounted directly above the coiled tubing head 20 is a blowout preventer stack 21 which would typically include four ram type blowout preventers, tubing rams 22, slip rams 23, cutter rams 24 and blind rams 25. The blowout preventers 21 are used, of course, as a primary means of well control during the running of coiled tubing.

Mounted between the blowout preventer stack 21 and the injector head 7 is a stuffing box or "stripper rubber" 26 which normally contains a split elastomer element which is compressed against the coiled tubing as it is injected into the well by the injector head assembly 7. The stripper 26 isolates the annulus wellbore pressure from the atmosphere.

Tubing to be injected into the well is normally stored on a coiled tubing reel (not shown) which may store 20,000 feet or more of tubing depending upon its diameter. The tubing 28 would be dispensed from the reel through a tubing guide 29 into the injector 7.

The injector 7 does not form a part of the present invention. There are several types of injectors which could be used. In one of design, used in the industry today, the continuous coiled tubing string is manipulated by utilizing two opposed sprocket-driven traction chains, which are powered by contra-rotating hydraulic motors. The chains are fabricated with interlocking saddle blocks mounted between chain links and machined to fit the particular coiled tubing diameter with which they are to be used. Hydraulically actuated compression rollers force the saddle blocks onto the coiled tubing with enough force to establish frictional drive. The tubing guide 29 essentially straightens the coiled tubing as it is fed into the injector head 7.

Figure 2:
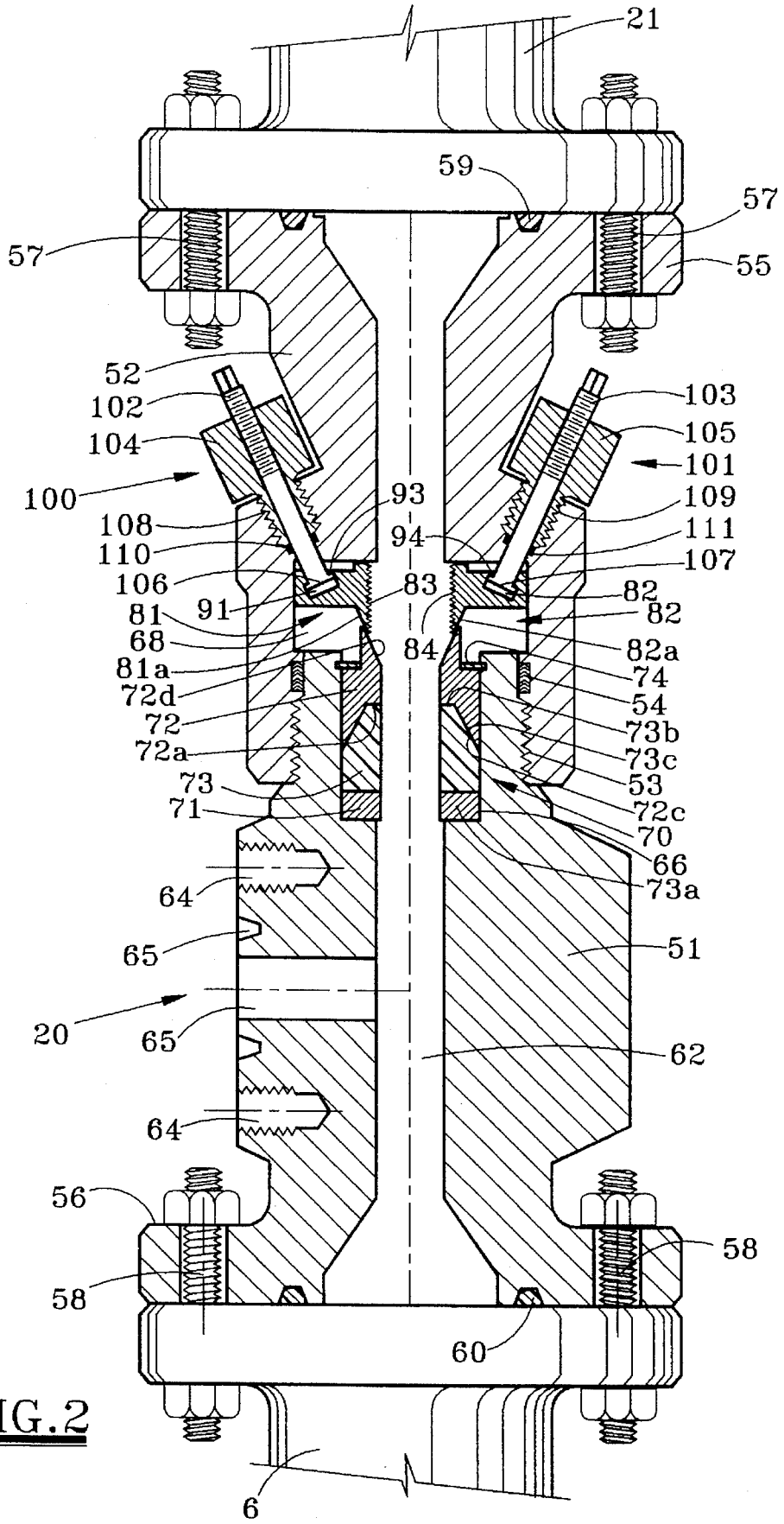
FIG. 2 is a vertical elevation view, in section, of a tubing hanger head, with seal and slip assemblies which are in passive positions for lowering coiled tubing therein with apparatus such as shown in FIG. 1, according to a preferred embodiment of the invention.

Referring now to FIG. 2, the specially designed tubing hanger apparatus of the present invention will be described in detail. The tubing head 20 comprises a lower body 51 and an upper body 52 connected by a threaded pin and box connection 53 which is sealed by an annular seal 54. The upper and lower ends of the tubing head 20 may be provided with pin and box type connections or with flanges 55 and 56 as shown in FIG. 2. Holes are provided in the flanges 55 and 56 for receiving bolts 57, 58 for connection to wellhead components such as the blowout preventers 21 and the master control valve 6 of FIG. 1. The flanges 55, 56 are provided with annular grooves for receiving seal rings 59, 60.

The body 51, 52 of the tubing hanger head 20 has a vertical flow passage 62 therethrough. An outlet flow passage 65 may be provided for communication with the annulus of the flow passage 62 when a coiled tubing (not shown) is concentrically positioned therein. Drilled and tapped holes 64 may be provided on the lower body 51 around the outlet 63 to receive the base of a valve or other component (not shown). An annular recess 65 may be provided for an annular seal ring (not shown).

The flow passage 62 may be counterbored in the lower body portion 51 to receive an annular sealing assembly 70. The annular sealing assembly 70 comprises three major components: a lower annular base plate or ring 71, an upper annular slip support member 72 and an annular elastomeric seal member 73 therebetween. The annular base plate 71 seats against an annular shoulder 66 provided at the base of the counterbored portion of flow passage 62. Initially, the sealing assembly 70 is placed in the counterbore of the lower body portion 51 with the upper body portion 52 removed. The outer diameter of the components of the sealing assembly 70 are slightly less than the diameter of the corresponding counterbored portion of flow passage 62 so that these components may be lowered thereinto. Once in place, a lock ring or retainer nut 74 may be placed in an annular groove or threads provided therefor to hold the sealing assembly 70 in place. The annular seal member 73, in the embodiment of FIG. 2, has a flat lower end **73*a* and a smaller annular flat upper end 73*b*. The annular seal member 73 has a cylindrical central opening therein through which coiled tubing to be run into the well may be lowered or raised. The lower exterior of seal member 73 in the embodiment of FIG. 2 is cylindrical. However, the upper portion of the outer exterior of the seal member 73 is tapered to provide an upwardly converging frusto-conical surface 73*c* which engages a corresponding upwardly converging frusto-conical surface 72*c* on the lower portion of the interior of the annular slip support member 72. The slip support member 72 has a downwardly facing annular surface 72*a* which engages the upwardly facing annular surface 73*b* of the seal member 73. The exterior of the slip support 72, which is of two diameters, is cylindrical. The smaller upper portion of the slip support member 72 is provided, on the interior thereof, with a downwardly converging frusto-conical surface 72*d***.

Figure 3:
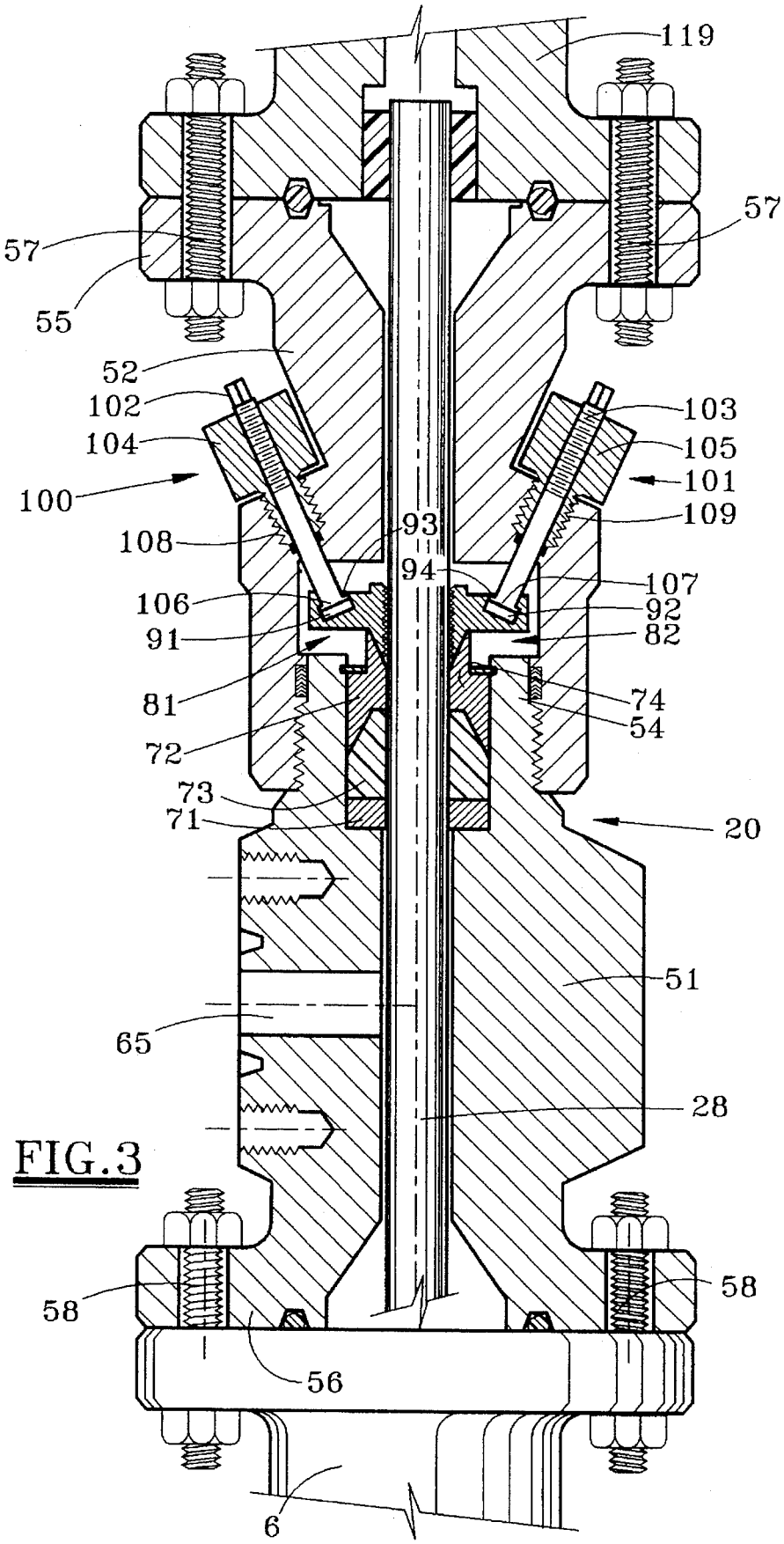
FIG. 3 is a vertical elevation view, in section, of the coiled tubing hanger head of FIG. 2, showing the seal and slip assemblies thereof in active positions for supporting and sealing coiled tubing concentrically disposed in the flow passage thereof.

The flow passage 62 has a second and larger counterbored portion 68 above the first mentioned counterbored portion. The second counterbored portion is actually provided in the upper body portion 52 of tubing head 20. Carried in the counterbored portion 68 is a slip assembly which comprises a plurality of segmented slip members 81, 82 having inner faces 83, 84 which are provided with gripping means such as toothlike projections for eventual gripping engagement with the coiled tubing which will be run therethrough. Although only two slip members 81, 82 shown in the drawings, there might be three, four, or more, uniformly placed around the passage 62 to provide substantially continuous engagement. The inner faces 83, 84 are curved so that when the slip members 81, 82 are eventually brought radially inward to engage the coiled tubing within the passageway 62, they essentially form a cylindrical shroud therearound. The lower portion of the slip members 81, 82, when brought radially inward define downwardly converging frusto-conical surfaces **81*a*, 82*a*, etc. which are engageable with corresponding downwardly converging frusto-conical surfaces 72*d* provided on the upper portion of the interior of the annular slip support 72. The body of the slips 81, 82, etc. are provided with inclined cylindrical recesses 91, 92 which are engageable by the inner ends of slip activation assemblies 100, 101, etc., one for each slip member 81, 82, etc. which are manipulatable externally of the tubing head 20 to move the slip assembly from the passive or inactive position of FIG. 2 to an active position (see FIG. 3) in which the gripping means on the slips engage the coiled tubing 28**.

In the preferred embodiment, the slip activation assemblies 100, 101 include a slip activation screw 102, 103, the upper end of which is threaded to engage corresponding threads of a gland nut 104,105 in a threaded connection. The gland nut 104, 105 has a reduced diameter threaded portion 108,109 which engages a corresponding threaded hole in the upper body 52 abutting an annular packing 110, 111 which seals the interior of the tubing head 20 from the exterior thereof. The lower ends of the slip activation screws 102, 103 are provided with enlarged heads 106, 107 which engage the corresponding cylindrical recesses 91, 92 of slips 81, 82 and are maintained therein by lock rings 93, 94. Rotation and extension of the activation screws 102,103 toward the flow passage 62 will force the slip members 81, 82 to move downwardly and inwardly toward the contracted active position of FIG. 3. Rotation of the activation screws 102,103 in the opposite direction results in retraction of the activation screws, effecting upward and outward movement of the slip members 81, 82 to the expanded, passive or inactive positions of FIG. 2.

Referring now to FIGS. 1, 2, 3 and 4, operation of the apparatus of the present invention and the method of installing coiled tubing in a well therewith will be described. As previously mentioned with reference to FIG. 1, the coiled tubing head 20 with the seal assembly 70 and slip assembly 81, 82, etc. previously installed as in FIG. 2 is mounted on one of the components of the wellhead 1 such as the master valve 6. The blowout preventer stack 21 is mounted on the coiled tubing head 20 and the coiled tubing injector apparatus, i.e. stripper 26, injector head 7, etc. are attached to the blowout preventers 21. Then the coiled tubing 28 is run through the blowout preventer stack 21, the coiled tubing head 20 and the casing head 2 until the string of coiled tubing 28 reaches the desired depth in the well.

As indicated, the seal assembly 70 and the slip assembly 81, 82, etc. are in the inactive or passive positions of FIG. 2 as the coiled tubing is being run into the well. Once the coiled tubing 28 reaches the desired depth, the slip assembly is activated externally of the coiled tubing head 20 by rotating the slip activation screws 102, 103 until the slips 81, 82 move downwardly and inwardly to the contracted active positions, grippingly engaging a portion of the coiled tubing 28 surrounded thereby. When this occurs, the coiled tubing 28 is slightly lowered to allow the weight thereof to be totally supported by the slips 81, 82, etc. The slips 81, 82, etc. transfer the weight of the coiled tubing 28 to the slip support member 72 of the sealing assembly 70. As this occurs, the seal 73 expands inwardly and outwardly to sealingly engage the coiled tubing 28 and the surrounding surface of the counterbore in which the sealing assembly 70 is disposed. See FIG. 3.

If for any reason, it is determined that the coiled tubing 28 needs to be repositioned lower or higher or removed, the weight of the coiled tubing 28 is first released from the slips 81, 82, etc. and the sealing assembly 70 by picking it up with the injector apparatus 7. Then the slips 81, 82, etc. are deactivated externally of the tubing head 20 by rotating the activation screws 102, 103 in the opposite direction, retracting the activation screws 102, 103 and moving the slips 81, 82 from their active contracted positions of FIG. 3 back to the expanded passive positions of FIG. 2. Since the weight of the coiled tubing 28 and the slips 81, 82, etc. is then removed from the seal assembly 70, the seal assembly 70 will assume the relaxed or nonset position of FIG. 2. The coiled tubing may be repositioned, higher or lower in the well and the slips 81, 82, etc. reactivated externally of the tubing head 20 so that the slips 81, 82 return to the contracted active positions grippingly engaging a portion of the coiled tubing 28 surrounded thereby. The coiled tubing 28 may then again be slightly lowered to allow the weight thereof to again be totally supported by the slips 81, 82, etc. and the sealing assembly 70, the weight thereof causing the sealing assembly 70 to again seal around the coiled tubing.

Once the coiled tubing is properly positioned in depth, the slips 81, 82, etc. set and the sealing assembly 70 properly sealed, the blowout preventer stack 21 and the injection apparatus 7 may be removed. At some point in this process, the coiled tubing 28 is cut at a point above the tubing head 20. Then additional wellhead equipment such as an adapter 119, an upper master valve 120, and other flow connections of a well manifold or Christmas tree 121 may be installed. See FIG. 4.

Thus, the apparatus and method of the present invention allows the running of coiled tubing into a well for production of fluids from the well with complete pressure control of the well at all times. The unique coiled tubing head and hanger apparatus contained therein eliminates the need for an access window assembly and the potential pressure control problems associated therewith. The hanger slips and seal of the present invention are initially positioned, prior to the running of the coiled tubing, so that there is no possibility of them being improperly disposed as in the case of prior art apparatus in which the hanger components must be wrapped around the coiled tubing through access windows and dropped down into a tubing head, sight unseen, with potential setting problems. The apparatus and method of utilizing the apparatus of the present invention in running of coiled tubing is unique and is a substantial improvement over the prior art.

A single embodiment of the apparatus of the present invention and method of use thereof have been described herein. However, many variations in the apparatus and methods of its use can be made without departing from the spirit of the invention. Accordingly, it is intended that the scope of the invention be limited only by the claims which follow.

I claim:

1. Hanger means for suspending coiled tubing in a well on the wellhead of which said hanger means is to be mounted, said hanger means comprising:

a tubing head having a vertical flow passage therethrough;

an annular sealing assembly carried in a first portion of said flow passage, said sealing assembly including an annular seal member having a central opening therein through which said coiled tubing may be lowered or raised but which when a vertical force is applied thereto, will expand outwardly to seal against surrounding surfaces of said hanger body and expand inwardly to seal against the exterior of said coiled tubing;

a slip assembly carried in a second portion of said flow passage above said sealing assembly, said slip assembly being moveable, independently of said coiled tubing, between an outwardly expanded passive position in which said slip assembly does not interfere with said flow passage and said lowering or raising of said coiled tubing therein and an inwardly contracted active position in which gripping means carried on said slip assembly engages said coiled tubing to support the weight thereof, said weight of said tubing being transferred from said slip assembly to said sealing assembly to provide said vertical force thereto; and slip activation means comprising a plurality of activation members radially disposed around said tubing head and having inner ends which engage said slip assembly carried within said second portion of said flow passage, said slip activation members being manipulatable externally of said tubing head for extension toward and retraction from said flow passage to move said slip assembly between said active and passive position, respectively.

2. Hanger means as set forth in claim 1 in which said tubing head includes sealingly engageable upper and lower body portions which are disengageable to permit removal or replacement of said sealing assembly and said slip assembly from or in said first and second portion of said flow passage.

3. Hanger means as set forth in claim 2 in which said first portion of said flow passage is provided in said lower body and said second portion of said flow passage is provided in said upper body.

4. Hanger means as set forth in claim 3 in which the lower end of said sealing assembly rests on an upwardly facing annular surface at the lower end of said first portion of said flow passage.

5. Hanger means as set forth in claim 3 in which said slip assembly comprises a plurality of segmented slip members carried in said second portion of said flow passage for limited axial and radial movement therein as said slip assembly moves between said passive and active positions.

6. Hanger means as set forth in claim 1 in which said seal assembly includes an annular base plate and an annular slip support member between which said annular seal member is disposed, said slip support member being engageable by said slip assembly, when in said active position, to support said coiled tubing thereon and by which said vertical force is applied to said sealing assembly.

7. Hanger means as set forth in claim 6 in which at least an upper portion of the outer exterior of said annular seal member is tapered to provide an upwardly converging frusto-conical surface and the lower portion of the interior of said annular slip support member is provided with a corresponding upwardly converging frusto-conical surface, so that at least a portion of the weight of said coiled tubing supported by said slip assembly is transmitted to said annular seal member as inwardly directed radial forces for sealing against said coiled tubing.

8. Hanger means as set forth in claim 7 in which said slip assembly comprises a plurality of segmented slip members having inner faces on which said gripping means are carried and outer faces which together define downwardly converging frusto-conical surfaces engageable with corresponding downwardly converging frusto-conical surfaces provided on the upper portion of the interior of said annular slip support member so that upon engagement of said gripping means with said coiled tubing and the supporting of the weight of said coiled tubing thereby, said slip members are wedged into tighter gripping engagement with said coiled tubing.

9. Hanger means as set forth in claim 8 in which said inner faces of said slip members are defined by substantially longitudinal cylindrical sections which when combined and in said active positions, define a cylinder which substantially surrounds a vertical section of said coiled tubing.

10. Hanger means as set forth in claim 9 in which said gripping means comprises a plurality of tooth members which, when said slip assembly is in said active position, radially and circumferentially engage said vertical section of said coiled tubing.

11. Hanger means as set forth in claim 1 in which said slip assembly comprises a plurality of slip members having inner faces on which said gripping means are carried and outer faces which together define downwardly converging frusto-conical surfaces engageable with corresponding downwardly converging surfaces therebelow so that upon engagement of said gripping means with said coiled tubing and the supporting of the weight of said coiled tubing said slip members are wedged into tighter gripping engagement with said coiled tubing.

12. Hanger means as set forth in claim 11 in which said inner faces of said slip members are defined substantially by longitudinal cylindrical sections which, when combined and in said active positions, form a cylinder which substantially surrounds a vertical section of said coiled tubing.

13. Hanger means as set forth in claim 12 in which said gripping means comprises a plurality of tooth members which, when said slip assembly is in said active position, radially and circumferentially engage said vertical section of said coiled tubing.

14. Hanger means as set forth in claim 11 in which said corresponding downwardly converging surfaces below said outer faces of said slip members is provided by a frusto-conical surface, carried on an upper portion of said sealing assembly.

15. Hanger means as set forth in claim 14 in which said sealing assembly comprises an upper slip support ring on which said frusto-conical surface is carried, a lower seal support ring which is supported on an annular surface provided within said tubing head and an elastomeric seal ring carried between said slip support ring and said seal support ring.

16. Hanger means as set forth in claim 15 in which the lower portion of said slip support ring and the upper portion of said seal ring are provided with cooperative oppositely facing frusto-conical surfaces which when wedged together by axial forces applied thereto force said seal ring into tighter sealing engagement with cylindrical surfaces engaged thereby.

17. Hanger means as set forth in claim 1 in which said activation members are downwardly inclined, relative to the axis of said flow passage, so that upon extension of said activation members toward said flow passage said slip assembly moves downwardly and inwardly toward said contracted active position, retraction of said activation members from said flow passage effecting upward and outward movement of said slip assembly toward said expanded passive position.

18. Hanger means as set forth in claim 1 in which said plurality of activation members comprise a plurality of screw members threadedly engaging corresponding threaded holes by which rotation of said screw members is translated to axial movement for said extension and retraction thereof.

19. Hanger means as set forth in claim 18 in which said corresponding threaded holes are provided by a plurality of corresponding gland nuts which engage corresponding holes provided in said tubing head, each of said gland nuts being provided with packing means sealing around said screw members to seal the interior of said tubing head from the exterior thereof.

20. A method of installing coiled tubing in a well having at least one string of pipe therein at the upper end of which is attached a wellhead, said method comprising the steps of:

installing a combination coiled tubing head and hanger on said wellhead, said coiled tubing head and hanger having therein a sealing assembly and a slip assembly, said slip assembly being activatable externally of said coiled tubing head for movement of said slip assembly, independently of said coiled tubing, between expanded passive positions and contracted active positions;

installing a blowout preventer stack above said coiled tubing head and hanger;

installing coiled tubing injector apparatus above said blowout preventer;

running coiled tubing through said tubing injector apparatus, said blowout preventer stack, said coiled tubing head and hanger, said wellhead and said string of pipe until the desired depth in said well is reached, said slip assembly being in an expanded passive position;

activating said slip assembly by rotating activating screws, attached thereto, externally of said tubing head, said slip assembly moving to a contracted active position grippingly engaging a portion of said coiled tubing surrounded thereby;

slightly lowering said coiled tubing to allow the weight thereof to be totally supported by said slip assembly, the weight of said coiled tubing also expanding said sealing assembly to seal around said coiled tubing, isolating annular spaces below said sealing assembly from annular spaces above said sealing assembly;

removing said injection apparatus and said blowout preventer stack;

cutting said coiled tubing at a point above said slip assembly; and installing other wellhead equipment above said coiled tubing head and hanger.

21. A method of installing coiled tubing as set forth in claim 20 in which said slip assembly is activated for movement to said contracted active position while the annular space in which said assembly is disposed remains isolated from the exterior of said tubing head.

22. A method of installing coiled tubing as set forth in claim 20 in which said slip assembly may be deactivated and returned to said expanded passive positions by rotating said activating screws in reverse directions.

23. A method of installing coiled tubing as set forth in claim 20 in which, prior to said cutting said coiled tubing, the following additional steps are performed:

the weight of said coiled tubing is released from said slip assembly and said sealing assembly;

said slip assembly is deactivated externally of said tubing head to move said slip assembly to said expanded passive positions;

said coiled tubing is repositioned, higher or lower in said well;

said slip assembly is reactivated externally of said tubing head, said slip means returning to said contracted active positions grippingly engaging a portion of said coiled tubing surrounded thereby;

slightly lowering said coiled tubing to allow the weight thereof to again be totally supported by said slip assembly and reexpanding said sealing assembly to seal around said coiled tubing; and continuing with said cutting of said coiled tubing, removing of said injection apparatus and installing of said other wellhead equipment as set forth in claim 21.

* * * * *